US005865302A

United States Patent [19]

Suzuki et al.

[11] Patent Number: 5,865,302

[45] Date of Patent: Feb. 2, 1999

[54] SWITCH KNOB HAVING ILLUMINATED INDICATOR

[75] Inventors: Hiroshi Suzuki; Kenichi Ishizuka, both of Tokyo, Japan

[73] Assignee: Niles Parts Co., Ltd., Japan

[21] Appl. No.: 826,128

[22] Filed: Mar. 27, 1997

[30] Foreign Application Priority Data

Mar. 28, 1996 [JP] Japan ..... 8-099013

[51] Int. Cl.[6] ..... H01H 9/26; H01H 9/00; H01H 21/24

[52] U.S. Cl. ..... 200/315; 200/5 A; 200/557

[58] Field of Search ..... 200/5 A, 313, 200/314, 315, 557

[56] References Cited

U.S. PATENT DOCUMENTS

| | | | |
|---|---|---|---|
| 3,482,542 | 12/1969 | Mace | 166/124 |
| 3,567,893 | 3/1971 | Ernst | 200/167 |
| 4,771,725 | 9/1988 | Miyaguchi . | |
| 5,095,409 | 3/1992 | Dematteo et al. | 362/23 |
| 5,403,984 | 4/1995 | Ogawa | 200/517 |
| 5,647,478 | 7/1997 | Hirai | 200/303 |

FOREIGN PATENT DOCUMENTS

95/30993 A1 11/1995 WIPO .

*Primary Examiner*—Wynn Wood Coggins
*Assistant Examiner*—Michael J. Hayes
*Attorney, Agent, or Firm*—Rader, Fishman & Grauer; Ronald P. Kananen

[57] ABSTRACT

A switch knob 1 having an operation portion 2, a cam system 3, a driving system 4, a steel ball 5, and a spring 6. The cam system 3, which is made of a molded, light transmissive material, is insertion molded into the operation portion 2, which is made of an opaque material. The cam system 3 includes an integral indicator 31 having a projected portion 32. A designated symbol is formed by the projected portion 32, which is exposed through the operation portion 2. Since the cam system 3 attached on the back side of the operation portion is light transmissive, the cam system 3 does not cause any inconsistency in the light at the indication portion. In addition, the number of parts comprising the switch knob 1 are minimized, and it is possible to maintain the quality of the symbols for extended periods.

3 Claims, 1 Drawing Sheet

FIG. 1
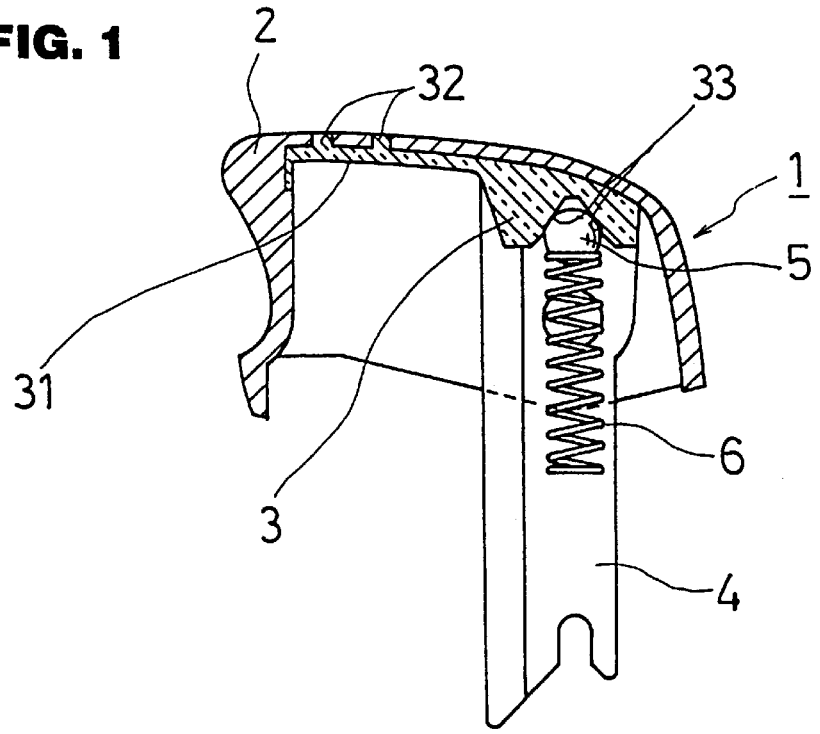
FIG. 2
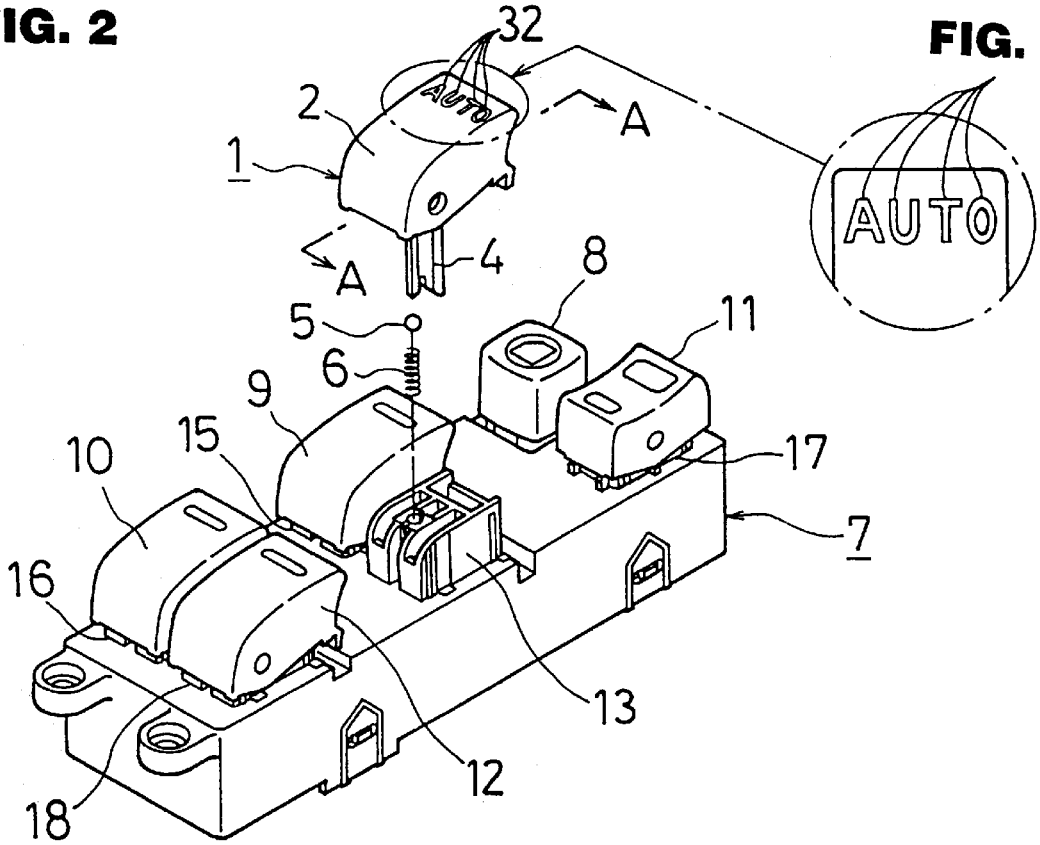
FIG. 2A

SWITCH KNOB HAVING ILLUMINATED INDICATOR

BACKGROUND OF THE INVENTION

1. Field of the Invention

The present invention relates generally to a switch knob having an indicator portion which is illuminated with light from a light source on the main body portion of the switch and, in particular, to an improved switch knob in which a light transmissive cam system is insertion molded into an operation portion of the switch knob.

2. Description of the Related Art

A conventional switch knob with a light is disclosed in Japanese Laid Open Patent Publication No. Sho 61-161843. The conventional switch knob has an illuminated portion lit by a light source such that the light from the light source is directed to the illuminated portion of the operation knob by guiding material so that the illuminated portion is continuously and brightly lit. There are symbols consisting of letters or numbers to indicate the functions controlled by the operation of the switch on the operation portion of the switch knob. In order to indicate the symbols, for example, an opaque plate in the shape of the symbol is insertion molded into the operation portion, or a transparent lens is insertion molded into the operation portion and the symbol is printed thereon.

However, in order to indicate the symbol on the operation portion of the switch knob, when an opaque plate is insertion molded into the shape of the symbol into the operation portion, as in the first method, there was a problem that the number of the parts that comprised the switch knob increased. In the latter method, when the symbol is printed on the operation portion, and the operation portion is operated by a finger over a long period of time, there is a problem that the printed symbol is abraded or peeled and eliminated. In addition, for the structure in which a cam system is located on the back side of the operation portion, the light on the indicator becomes inconsistent because the cam system becomes an obstacle.

SUMMARY OF THE INVENTION

An object of the present invention is to solve the problems with the conventional switch structures described above.

More specifically, it is an object of the present invention to provide a switch that has a cam system located on the back side of the operation portion that does not cause an inconsistency of the light of the indicator due to the cam system.

It is a further object of the present invention to keep the parts comprising the switch knob to a minimum and to maintain the quality of the symbols over a long period of time.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, a switch knob is provided, comprising: an operation portion formed of a molded opaque material; and a cam system formed of a molded light transmissive material, the cam system being insertion molded into the operation portion such that part of the cam system is exposed through the operation portion and used as an indicator.

The indicator of the switch knob preferably comprises a projected portion in the form of designated symbols which are exposed through the operation portion. The designated symbols formed by the projected portion can be letters or the like.

In accordance with another aspect of the present invention, an illuminated knob for a switch is provided, comprising: an operation portion formed of a molded opaque material having an upper surface facing away from the switch; and a cam system formed of a molded light transmissive material, the cam system being insertion molded into the operation portion such that an integral projected portion of the cam system is exposed through the upper surface of the operation portion, the projected portion of the cam system thereby providing an illuminated indicator.

The light transmissive cam system preferably comprises a contacting cam surface facing away from the upper surface of the operation portion, the contacting cam surface being engaged by a spring-biased detent member to bias the illuminated knob into a neutral position.

BRIEF DESCRIPTION OF THE DRAWINGS

The present invention will become more clearly appreciated as the disclosure of the invention is made with reference to the accompanying drawings. In the drawings:

FIG. 1 is a cross-section of a knob according to a preferred embodiment of the present invention as viewed along the line A—A in FIG. 2.

FIG. 2 and 2A is a perspective view of a power window switch equipped with a knob according to the present invention.

DETAILED DESCRIPTION OF THE PREFERRED EMBODIMENT

A preferred embodiment of a switch and switch knob according to the present invention will now be described in detail with reference to FIGS. 1 and 2 of the drawings.

As shown in FIG. 2, a power window switch 7 has an upper portion on which a plurality of knobs 1, 8, 9, 10, 11, and 12 are arranged. The present invention will be described by reference to the knob 1, which is shown in an enlarged cross-section view in FIG. 1, as viewed along the line A—A in FIG. 2.

The knob 1 is comprised of an operation portion 2 formed of a molded opaque material, such as, for example, ABS resin colored black, a cam system 3 (also referred to herein as a light transmissive portion); insertion molded into the operation portion 2, a driving system 4 arranged next to the cam system 3, a steel ball 5 that contacts a cam surface 33 of the cam system 3, (also referred to herein as a light transmissive step groove) and a spring 6 that presses the steel ball 5 onto the cam surface 33. The cam surface 33 faces away from an upper surface of the operation portion 2 and is engaged by the steel ball 5, which provides a spring-biased detent member to bias the knob 1 into a neutral position.

The cam system 3 is a molded, light transmissive material, such as polyacetal resin. The cam system 3 forms an integral indicator 31 that protrudes away from where the cam surface 33 of the cam system 3 is formed. On the indicator 31, a projected portion 32 is formed in a designated symbol shape. For example, as shown in FIG. 2, the projected portion 32 can form the word "AUTO". Of course, the projected portion 32 can also form a number, another word, or other alphanumeric characters. The indicator 31 is buried inside the operation portion 2 by insertion molding, but only the projected portion 32 is exposed from the operation portion 2 so that the symbols of the letters "AUTO" are formed on the surface of the operation portion 2.

The knob 1 has the driving system 4 and the spring 6 inserted into the supporting frame on the upper portion of the power window switch 7. The knob 1 is assembled by pressure fitting into the power window switch 7 with appropriately fitting parts (not shown) on the supporting frame 13. Inside the supporting frame 13 there is a light source structure (not shown), such as a light emitting diode, and underneath the supporting frame there is a contact point system for the switch (not shown). The driving system 4 of the knob 1 is fit into the contact point system of the switch so that the contact point can be switched by operation of the knob 1. In a similar way, the other knobs 8, 9, 10, 11, and 12 are also pressure fit to supporting frames 14, 15, 16, 17, and 18 on the upper portion of power window switch 7. The driving system for each knob 8, 9, 10, 11, and 12 is fit into each contact point system of each switch. The contact point system is connected to a control circuit, such as, for example, a window regulator control.

The operation of the switch and switch knob described above will be explained next.

Light emitted by the light source equipped in the power window switch 7 illuminates the cam system 3 and the indicator 31. This light reflects inside the cam system 3 and reaches the projected portion 32 after being guided by the indicator 31 or reaches the projected portion 32 by directly entering the back side of the indicator 31. Therefore, the letters of the symbol "AUTO" formed by the projected portion 32 are illuminated in correspondence to the illumination intensity of the light source. When the operation portion 2 is operated, the operating power is transmitted to the contact point system inside the power window switch 7 via the driving system 4 to switch the contact point system to an "ON" position. The control circuit controls the corresponding window regulator when the control circuit receives an "ON" signal to open and close the window.

The cam system 3 described above utilizes a railing cam structure that has a railing in the knob. However, it is possible to have a cam structure having a different shape, such as, for example, a heart-shaped cam system that temporarily maintains the knob in the "ON" position. For the light sources, except for elements that are auto-light emitting elements, it is acceptable to utilize external lights. Thus, several modifications of the present invention are possible.

The invention as described above provides a switch knob for which the knob of the switch has an operation portion formed of a molded opaque material and a cam system, which is insertion molded into the operation portion. The cam system is formed of a molded light transmissive material, such that part of the cam system is exposed through the operation portion of the knob and used as an indicator. Therefore, even though there is a cam system behind the operation portion, the cam system does not cause an inconsistency of light in the indication portion. Also, the number of parts that comprise the switch knob are minimized, and the quality of the symbols can be maintained over a long period of time.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. An illuminated knob for a switch, comprising:

an operation portion formed of a molded opaque material having an upper surface facing away from the switch; and a light transmissive portion formed of a molded light transmissive material, said light transmissive portion being insertion molded into said operation portion such that an integral projected portion of said light transmissive portion is exposed through said upper surface of said operation portion, said projected portion of said light transmissive portion thereby providing an illuminated indicator, said light transmissive portion further comprising a light transmissive step groove formed integral with said projected portion, said step groove facing away from said upper surface of the operation portion; and a spring-biased member biased into engagement with said light transmissive step groove for biasing the illuminated knob into a neutral position.

2. The illuminated knob according to claim 1, wherein said projected portion forms one or more designated symbols exposed through said upper surface of the operation portion.

3. The illuminated knob according to claim 2, wherein said designated symbols comprise alphanumeric characters.

* * * * *